US011541684B2

(12) United States Patent
Hanley et al.

(10) Patent No.: US 11,541,684 B2
(45) Date of Patent: Jan. 3, 2023

(54) CHALK LINE MARKING APPARATUS

(71) Applicant: Innovations Specific, Inc., Fort Collins, CO (US)

(72) Inventors: Jerome Charles Hanley, Fort Collins, CO (US); Duane Neil Genzlinger, Pierce, CO (US)

(73) Assignee: Innovations Specific, Inc., Fort Collins, CO (US)

( * ) Notice: Subject to any disclaimer, the term of this patent is extended or adjusted under 35 U.S.C. 154(b) by 15 days.

(21) Appl. No.: 17/359,122

(22) Filed: Jun. 25, 2021

(65) Prior Publication Data

US 2022/0153059 A1 May 19, 2022

Related U.S. Application Data

(60) Provisional application No. 63/114,998, filed on Nov. 17, 2020.

(51) Int. Cl.
*B44D 3/38* (2006.01)

(52) U.S. Cl.
CPC ..... *B44D 3/38* (2013.01)

(58) Field of Classification Search
CPC ..... B44D 3/38
See application file for complete search history.

(56) References Cited

U.S. PATENT DOCUMENTS

| | | | | |
|---|---|---|---|---|
| 2,601,788 | A * | 7/1952 | Parker | B23D 49/167 74/22 A |
| 4,197,656 | A * | 4/1980 | Lane | B44D 3/38 33/414 |
| 4,579,296 | A * | 4/1986 | Karlsson | A01K 89/0189 192/93 R |
| 4,775,112 | A * | 10/1988 | Urso | A01K 89/01901 242/234 |
| 5,699,622 | A | 12/1997 | Umbro | |
| 5,822,874 | A * | 10/1998 | Nemes | B44D 3/38 33/413 |
| 6,895,679 | B2 * | 5/2005 | Dekort | B44D 3/38 33/767 |
| 6,944,962 | B2 | 9/2005 | Tessel et al. | |
| 7,707,734 | B2 | 5/2010 | Alexander | |
| 2004/0211074 | A1 * | 10/2004 | Tessel | B44D 3/38 33/414 |
| 2022/0153058 | A1 * | 5/2022 | Hanley | B44D 3/38 |
| 2022/0153059 | A1 * | 5/2022 | Hanley | B44D 3/38 |

FOREIGN PATENT DOCUMENTS

WO 2004094165 A2 11/2004

* cited by examiner

*Primary Examiner* — Yaritza Guadalupe-McCall
(74) *Attorney, Agent, or Firm* — Bridget A. Cochran; Cochran Freund & Young LLC

(57) ABSTRACT

Disclosed is a chalk line marking apparatus having an ambidextrous trigger. The trigger has an angled cord cavity channel that directs a marking cord in a downward direction so that the marking cord is flush with a surface to be marked.

24 Claims, 15 Drawing Sheets

CHALK LINE MARKING APPARATUS

CROSS-REFERENCE TO RELATED APPLICATION

This Non-Provisional patent application claims the benefit of the U.S. Provisional Patent Application No. 63/114,998, entitled "Chalk Line Marking Apparatus," which was filed with the U.S. Patent & Trademark Office on Nov. 17, 2020, which is specifically incorporated herein by reference for all that it discloses and teaches.

BACKGROUND

Construction is an important and popular industry that frequently requires measuring, and marking a straight line between two points. Utilizing a cord or string covered in chalk is a useful way to mark a straight line on a surface.

SUMMARY

An embodiment of the present invention may therefore comprise a chalk line marking apparatus comprising: a left housing; a right housing coupled to the left housing, the left housing and the right housing forming a chalk cavity when joined together; a handle comprising a handle base and at least one handle knuckle; a crank comprising an angled shaft and at least one crank knuckle; a pin hingedly connecting the at least one handle knuckle and the at least one crank knuckle so that the handle base is configured to rotate about the crank; a spool configured to hold a marking cord; an axle comprising an angled left cavity that mates with the angled shaft of the crank and is secured to the crank by a crank screw; a clutch that allows the marking cord to be unwound from the spool; a trigger comprising a trigger bottom, a trigger actuator, a front trigger flange, a rear trigger flange, a trigger shaft, a cord entry aperture, a cord cavity located on the trigger bottom, and an angled cord cavity channel that extends at an angle between the cord cavity aperture and the cord cavity; a trigger spring having one end disposed on the trigger shaft, and an opposite end of the trigger spring disposed on a spring stop shaft located on the left housing, wherein the trigger spring is configured to bias the trigger in a downward direction towards a surface to be marked so that the chalk line marking apparatus marks a chalk line on a surface.

An embodiment of the present invention may further comprise a method of using a chalk line marking apparatus comprising: allowing a marking cord inside of the chalk line marking apparatus to be covered with powdered chalk contained in a chalk cavity formed by a right side housing and a left side housing; pulling the marking cord from a marking cord cavity using a clutch that allows a spool, wound with the marking cord, to rotate and unwind from the spool, the marking cord cavity located on a bottom side of a trigger; moving the marking cord, as the marking cord is pulled from the marking cord cavity, through an angled cord cavity channel through a trigger at a downward angle so that the marking cord exits the trigger from the cord cavity, located at a bottom side of the trigger, at a downward angle that ensures that the marking cord contacts a marking surface; lifting a trigger actuator of a trigger against a bias created by a trigger spring so that a front trigger flange moves along a left side front trigger channel and a right side front trigger channel, and a rear trigger flange moves along a left rear trigger channel and a right side rear trigger channel of a left housing and a right housing; moving a trigger neck along a trigger slot located between the left housing and the right housing by the lifting the trigger actuator; releasing the trigger actuator so that the trigger spring forces the trigger and the marking cord downwardly towards a surface to be marked so that the cord is flush with the surface.

An embodiment of the present invention may further comprise a method of making a chalk line marking apparatus comprising: passing a marking cord from a spool through a first passage housing and a second passage housing of the chalk line marking apparatus; passing the marking cord through a cord entry aperture on a trigger, through an angled cord cavity channel on the trigger, and out of the angled cord cavity channel on a bottom portion of the trigger that ensures that the marking cord contacts a surface to be marked and creates an accurate chalk line mark on the surface to be marked when the trigger is actuated; providing trigger guides on the chalk line marking apparatus that allow the trigger to move the marking cord and compress a trigger spring so that the marking cord is snapped against the surface to be marked when the trigger is released.

DETAILED DESCRIPTION OF THE EMBODIMENTS

Figure 1:
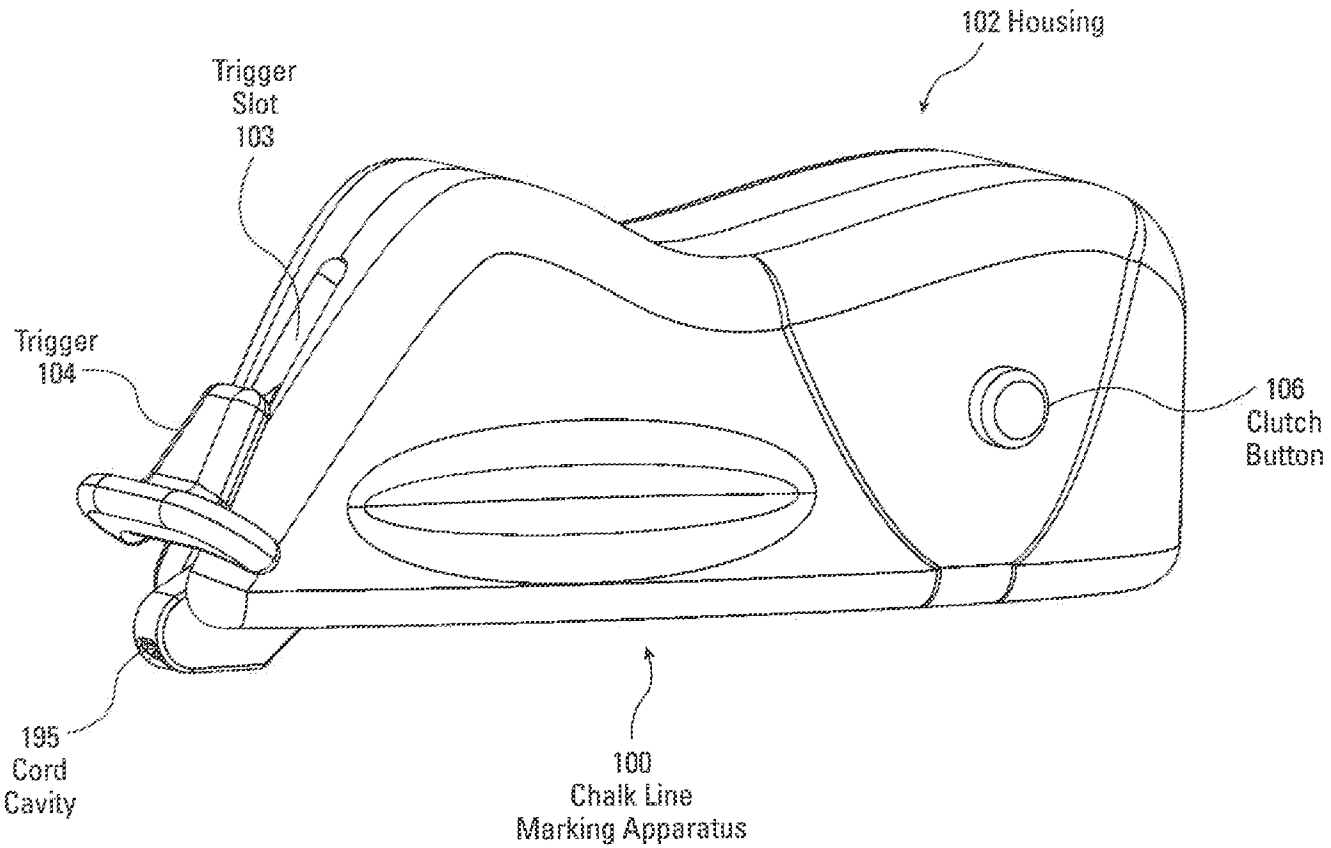
FIG. 1 is an isometric view of an embodiment of a marking apparatus.

FIG. 1 is an isometric view of an embodiment of a chalk line marking apparatus 100. Chalk line marking apparatus 100 is an apparatus that is used to mark a chalk line on a surface. Typically, when a user wants to mark a chalk line, they have both hands occupied from holding each side of the cord and often need a second person to snap the chalk-covered cord. This also removes the need to drive a fastener, such as a screw or nail, into the material to be marked in order to secure one end of the chalk line while snapping a line. Chalk line marking apparatus 100 is very useful and convenient because it allows a user to snap the chalk-covered cord with one of their fingers while holding housing 102. FIG. 1 shows chalk line marking apparatus 100 having housing 102, clutch button 106, and trigger 104. Housing 102 of chalk line marking apparatus 100 holds a marking cord 192 (see FIGS. 6 and 7) and powdered chalk. Chalk line marking apparatus 100 has a clutch button 106, a trigger 104, a trigger slot 103 and a cord cavity 195. Cord cavity 195 is the cavity where the marking cord 192 (FIGS. 7-8) exits the chalk marking line apparatus 100 and is ready to be snapped by trigger 172. It should be noted that cord cavity 195 is located on a bottom surface of trigger 104 which causes marking cord 192 to be flush with the surface to be marked when the marking cord 192 marks the surface. The marking cord 192 being flush with the surface causes great accuracy when a chalk line mark is produced. When clutch button 106 of chalk line marking apparatus 100 is pressed, marking cord 192 can be freely pulled out of cord cavity 195, pulled to a distance desired, and a user is able to use the hand holding the housing 102 to pull on the trigger 104 to create a chalk line mark. Although not shown, the end of marking cord can have a hook type of mechanism (as known in the art) in the case that a user desires to have the outside far end of the marking cord a distance greater than their arm span. Trigger 104 is biased by a trigger spring 152 (FIG. 2) in a downward direction towards cord cavity 195. When a user would like to produce a chalk line mark, the user pulls trigger 104 upward along trigger slot 103 and then releases the trigger 104, which causes the trigger 104 to snap downwards because of the bias of the trigger spring 152 (FIG. 2) so that marking cord 192 is snapped on a surface, therefore creating a marking line.

Figure 2:
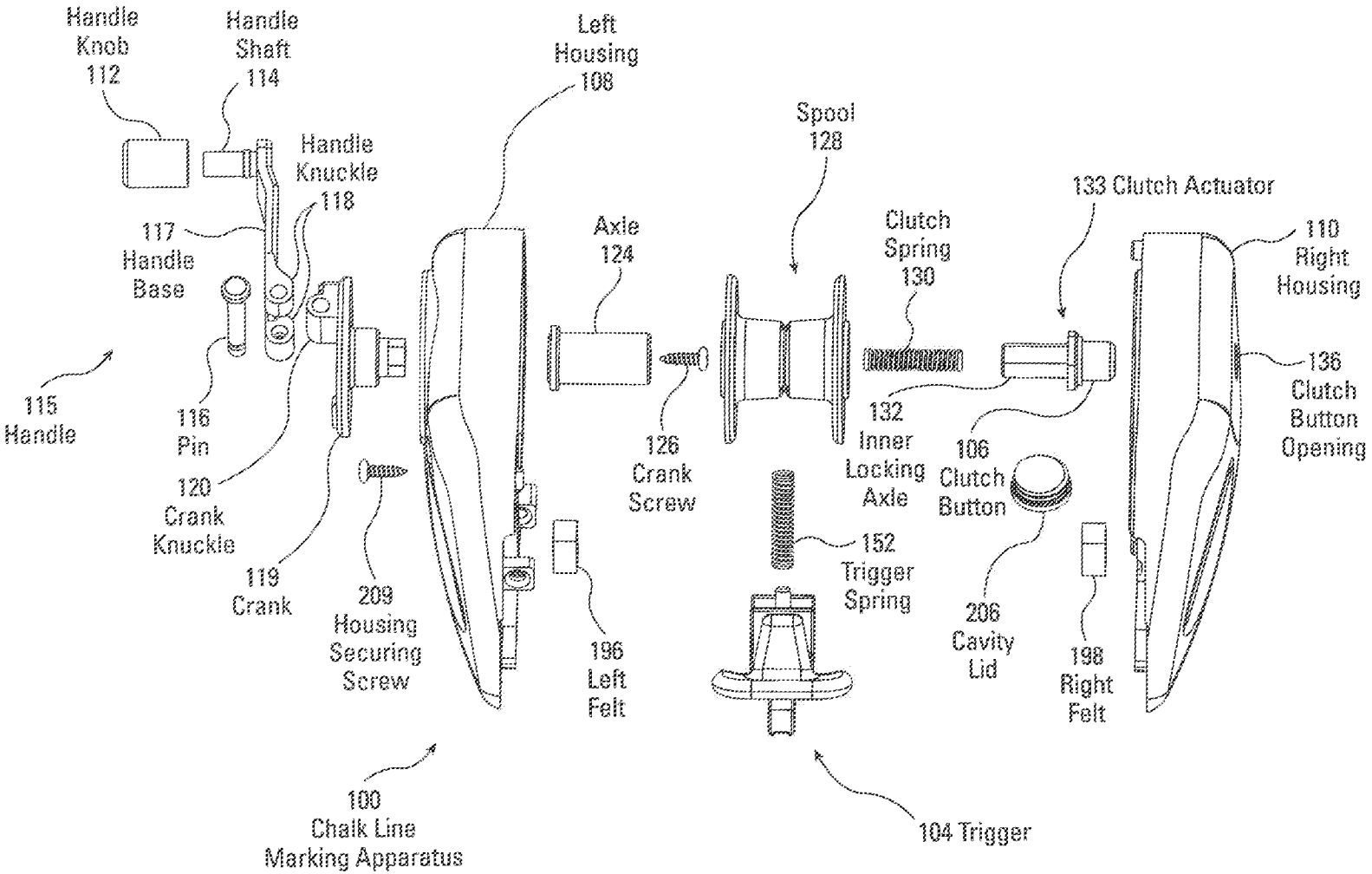
FIG. 2 is an exploded front view of FIG. 1.
Figure 7:
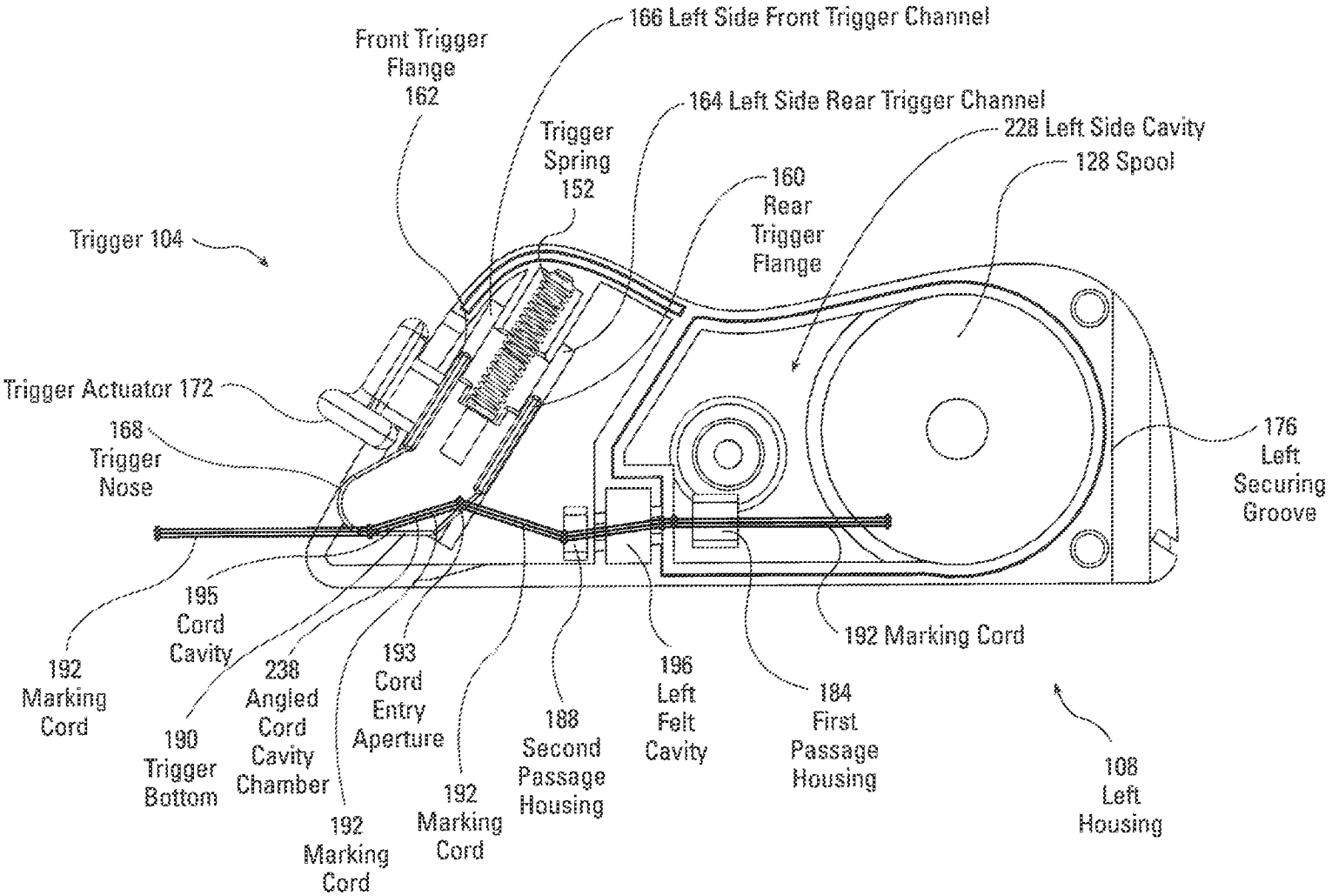
FIG. 7 is a side view of left housing shown in FIG. 2.
Figure 8:
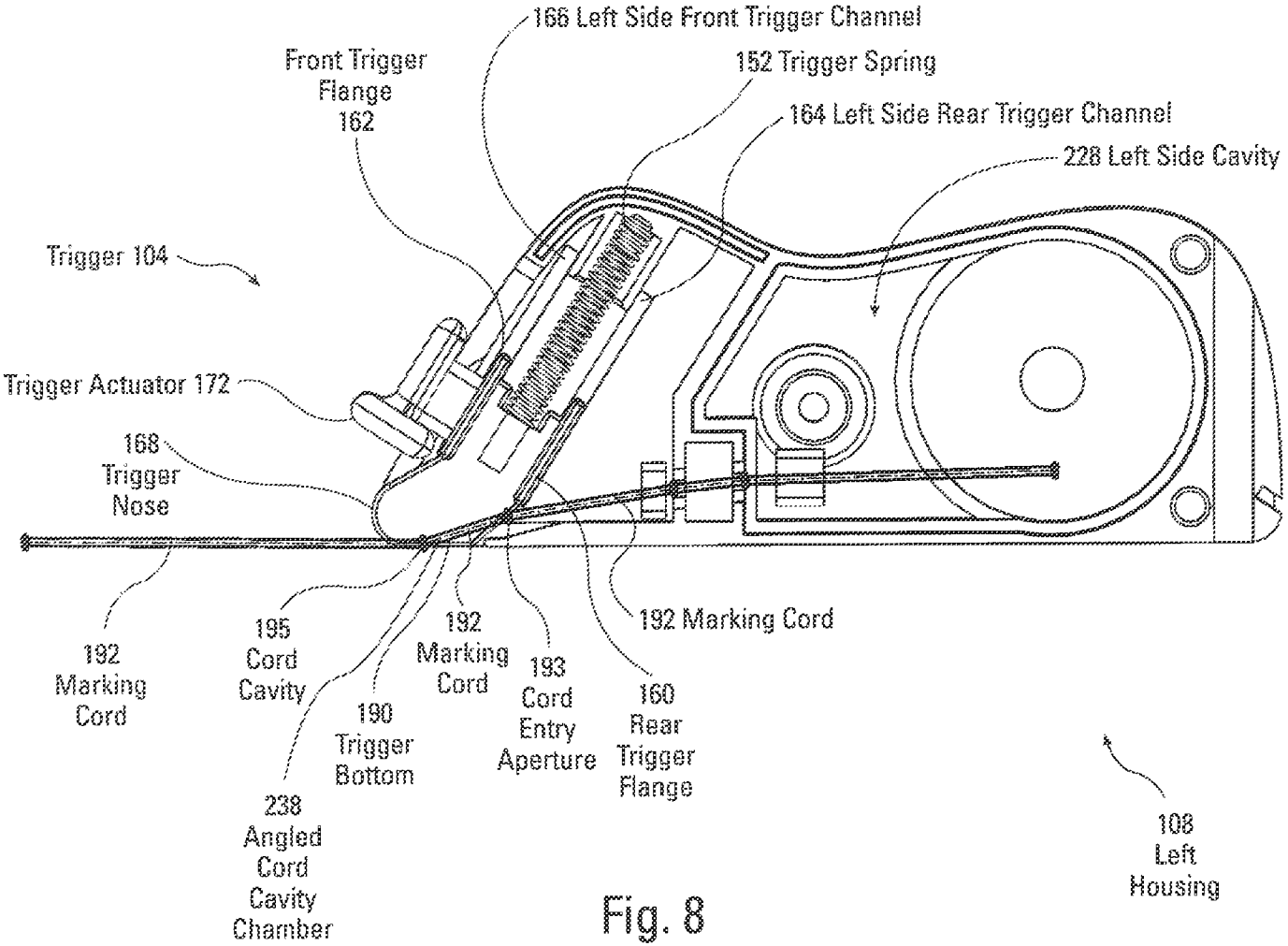
FIG. 8 is a side view of left housing shown in FIG. 2.

FIG. 2 is an exploded front view of FIG. 1 and shows the elements of chalk line marking apparatus 100 and assembly. Marking apparatus 100 has a handle 115, a handle base 117, a handle shaft 114, a handle knob 112, and handle knuckle 118. Handle 115 is coupled to a crank 119 by aligning handle knuckle 118 with crank knuckle 120. FIG. 2 shows handle knuckle 118 having two knuckles and crank 119 having a single crank knuckle, however, both the handle base 117 and crank 119 can have a single handle knuckle or multiple knuckles. Pin 116 secures handle knuckle 118 and crank knuckle 120 in a hinged manner that allows handle base 117 to rotate about crank 119. Handle knob 112 is coupled to handle shaft 114 in a manner so that handle knob 112 is able to freely rotate about handle shaft 114. Crank 119 is coupled to left housing 108 and axle 124 by a crank screw 126. A spool 128 that holds the marking cord 192 (FIGS. 7-8) is slid onto axle 124. FIG. 2 also shows a clutch actuator 133 that comprises an inner locking axle 132 and the clutch button 106. Axle 124 has an angled right cavity 218 (FIG. 11) that matches the shape of the outside surface of inner locking axle 132 of clutch actuator 133. Interlocking axle 132 mates with and goes inside of the angled right cavity 218 (FIG. 11) of axle 124. A clutch spring 130 is disposed between axle 124 and inner locking axle 132, which causes the clutch button 106 and the inner locking axle 132 to be biased in an outwardly direction by clutch spring 130. Clutch button 106 being biased outwards, extends through clutch button opening 136 of right housing 110. FIG. 2 also shows trigger 104 that is used to snap the marking cord 192 (FIGS. 7-8), trigger spring 152, left felt 196, and right felt 198, and cavity lid 206. Left felt 196 and right felt 198 are used to clean the marking cord 192 so that excessive chalk is not disposed on the marking cord 192 (FIGS. 7-8). Cavity lid 206 is used to close a chalk aperture 202 (FIG. 9) where powdered chalk is disposed in the chalk line marking apparatus 100.

Figure 3:
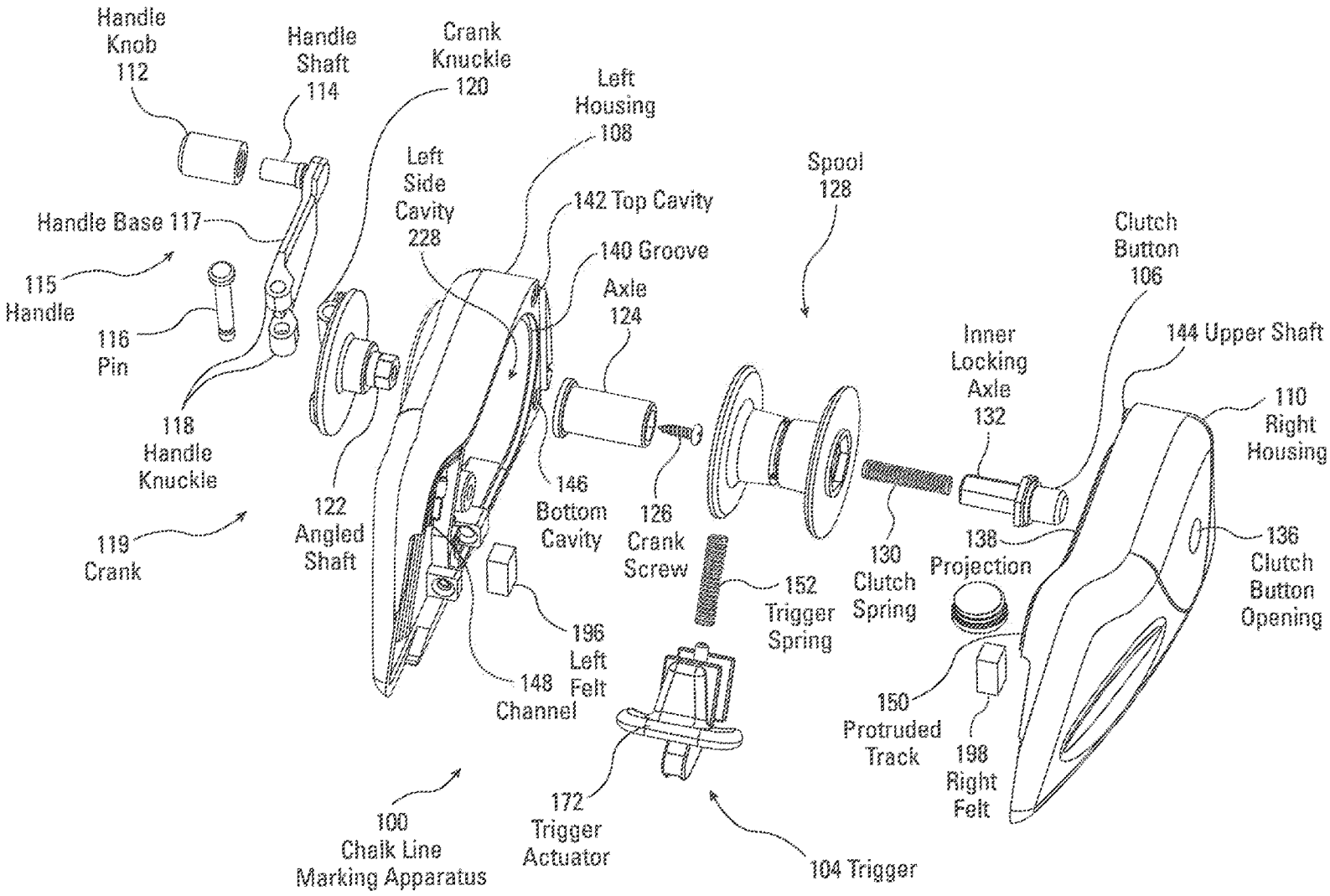
FIG. 3 is an isometric view of FIG. 2.
Figure 10:
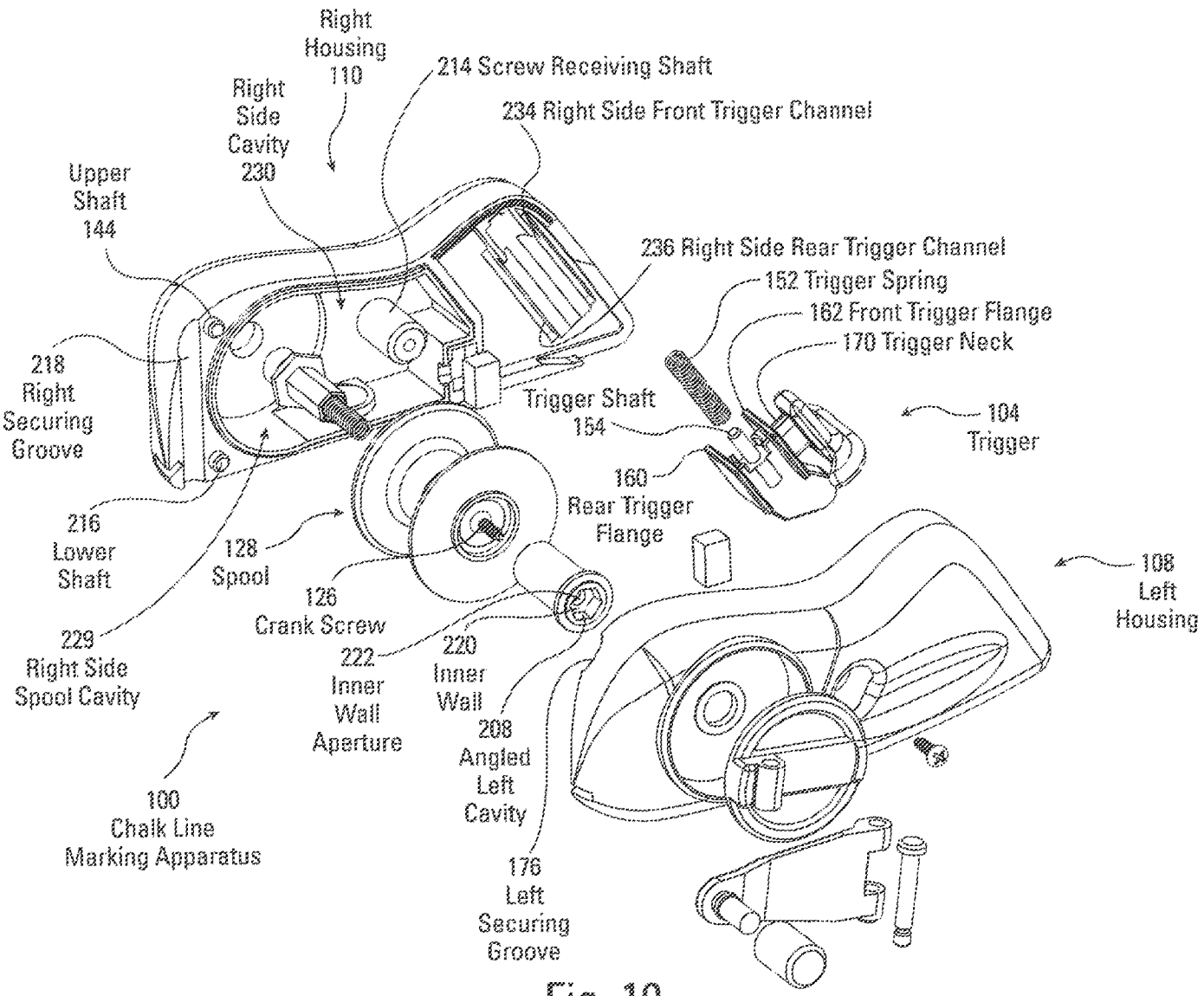
FIG. 10 is an isometric view of FIG. 2.

FIG. 3 is an exploded isometric view of the marking apparatus 100 and showing the elements previously discussed in FIG. 2. FIG. 3 further illustrates in more detail how axle 124 mates with inner locking axle 132, and the manner in which left housing 108 and right housing 110 are coupled. Left housing 108 has channel 148 that mates with a protruded track 150 located on right housing 110 in a manner such that protruded track 150 goes inside of channel 148. Groove 140 on left housing 108 mates with projection 138, located on right housing 110. Left housing 108 has a top cavity 142 and a bottom cavity 146 that mate with an upper shaft 144, and a lower shaft 216 (FIG. 10). The manner in which left housing 108 and right housing 110 are securely coupled makes chalk line marking apparatus 100 resistant to fluids, including water. Additionally, FIG. 3 shows trigger 104 having a trigger actuator 172. Trigger actuator 172 is the part of the trigger that is pulled to snap the marking cord 192 (FIGS. 7-8). Trigger actuator has a shape that extends forwardly and spans out on the left and right sides, which allows a user to easily access the trigger actuator 172 using any finger or thumb on either hand, and as such, is an ambidextrous trigger.

Figure 4:
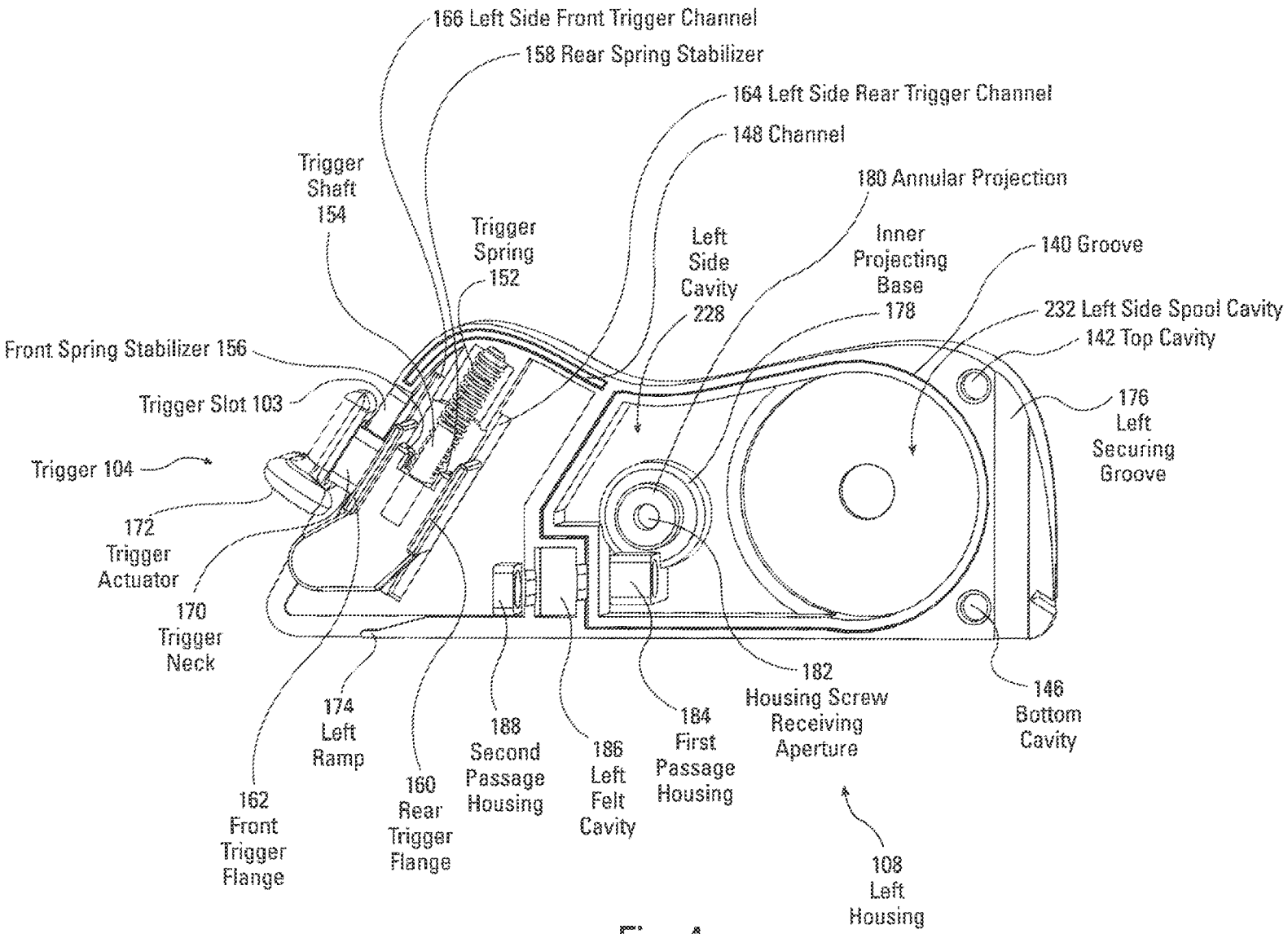
FIG. 4 is a side view of left housing shown in FIG. 2.

FIG. 4 is a side view of the left housing 108, shown in FIG. 2. FIG. 4 shows trigger actuator 172 extending on the side and front (FIG. 3). As discussed earlier, a user is able to actuate trigger actuator 172 by pulling up trigger actuator 172 on the right side, the left side, the center, or anywhere in between using either hand or any finger or thumb. In other words, trigger actuator 172 is shaped and designed so chalk line marking apparatus 100 is ambidextrous and can be used by both right-handed and left-handed users, using any finger or thumb on any portion of trigger actuator 172. Trigger 104 has a trigger neck 170 that slides along trigger slot 103. Trigger 104 has a front trigger flange 162 and a rear trigger flange 160 that slide along left side front trigger channel 166 and left side rear trigger channel 164. Trigger 104 has a trigger shaft 154, a front spring stabilizer 156 and a rear spring stabilizer 158. Trigger spring 152 is disposed on trigger shaft 154 and is assisted in being stabilized by front spring stabilizer 156 and rear spring stabilizer 158. The opposite end of trigger spring 152 is secured to a spring stop shaft 212 (FIG. 11) located on left housing 108. Also shown in FIG. 4 is channel 148, groove 140, top cavity 142, and bottom cavity 146 that mate with projection 138, protruded track 150, upper shaft 144, and lower shaft 216 of right housing 110 (FIGS. 3 and 9), as previously discussed. Left housing 108 has a shape that forms a left side spool cavity 232 where one side of spool 128 (FIG. 3) is disposed. Left side spool cavity 232 allows spool 128 (FIG. 3) to rotate freely when clutch button 106 (FIG. 3) is pressed. Spool 128 is wound with marking cord 192 (FIGS. 7-8) and has an end that goes through a first passage housing 184, left felt cavity 186, and second passage housing 188, and through an angled cord cavity channel 238 in the trigger (FIGS. 7-8). Left housing 108 also has an inner projecting base 178 and an annular projection 180 that extends from the inner projecting base 178. Inner projecting base 178 creates a handle knob lock 195 (FIG. 9) on the outside of the left housing 108, which is a cavity where handle knob 112 of handle 115 (FIG. 3) can be secured while marking a chalk line. As can be seen in FIG. 4, inner projecting base 178 and annular projection 180 have a housing screw receiving aperture 182 where a housing securing screw 209 (FIG. 2) is inserted to secure the left housing 108 and the right housing 110 (FIG. 3). Although housing securing screw 209 is shown to secure the right housing 110 and the left housing 108, other securing means can be used to secure the right housing 110 and the left housing 108, such as, but not limited to bonding agents such as adhesives, ultrasonic welding, infrared welding, etc. The inner projecting base 178 and the annular projection 180 create a closed-off outside surface (a sealing surface) for the handle knob lock 195 (FIG. 9) so that the chalk line marking apparatus 100 remains resistant to liquids. FIG. 4 also shows a left securing groove 176. When left housing 108 and right housing 110 (FIG. 10) are connected, and left securing groove 176 and right securing groove 218 (FIG. 10) are aligned, left securing groove 176 and right securing groove 218 form an aperture that can be utilized in the case that a user wants to secure chalk line marking apparatus 100 to a surface by using a nail, screw, or similar device.

Figure 5:
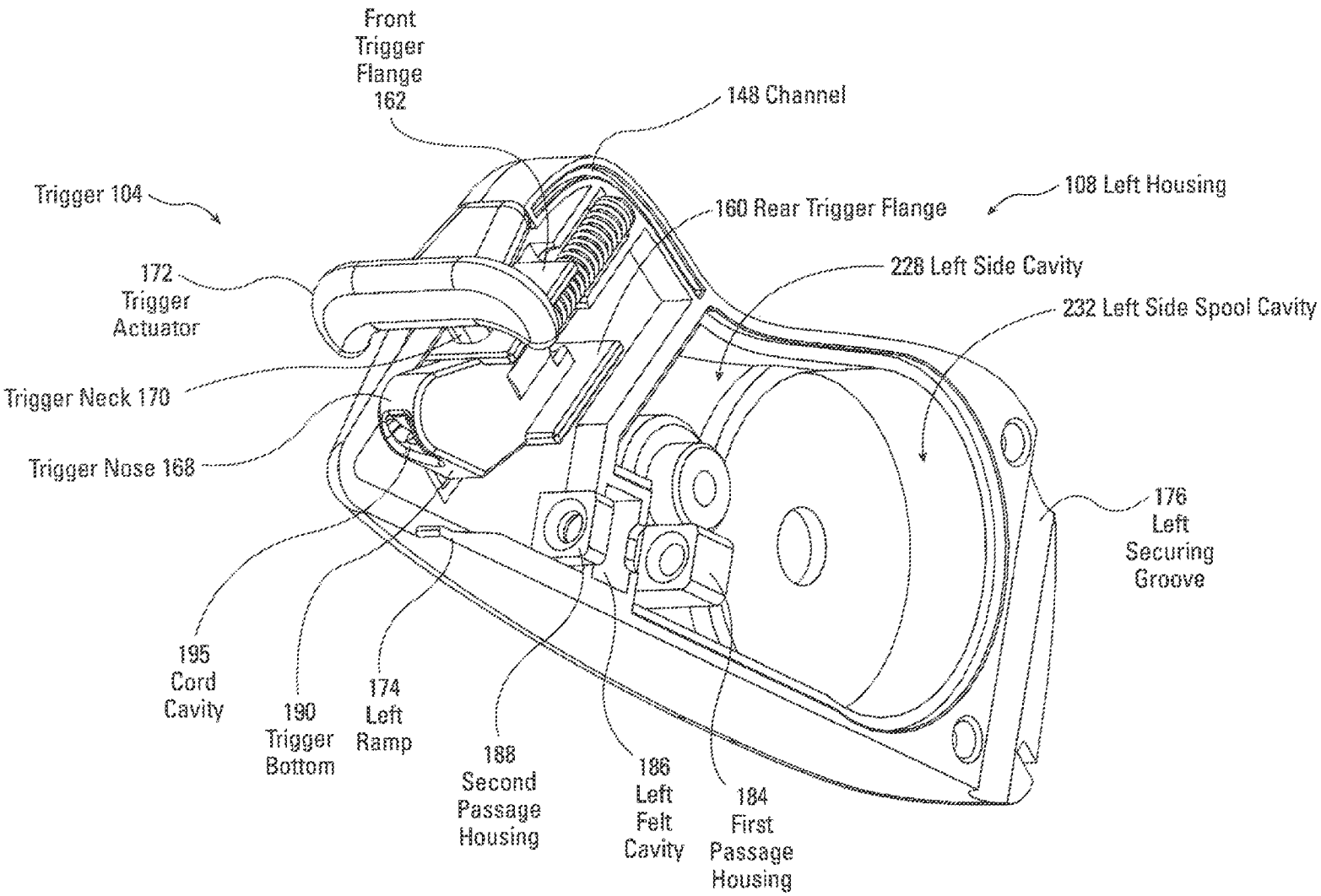
FIG. 5 is an isometric view of FIG. 4.

FIG. 5 is an isometric view of FIG. 4 further illustrating trigger actuator 172, front trigger flange 162, trigger neck 170, channel 148, rear trigger flange 160, left side spool cavity 232, left side cavity 228, left securing groove 176, first passage housing 184, left felt cavity 186, and second passage housing 188. FIG. 5 also shows a left ramp 174 that is flush with trigger bottom 190 so that when the trigger 104 is in the downward position, cord cavity 195 allows marking cord 192 (FIGS. 7-8) to be flush with a marking surface which results in an accurate and clear chalk line mark. In other words, cord cavity 195 where marking cord 192 exits the trigger 104, is below trigger nose 168 and allows marking cord 192 to be flat with the surface that is receiving a chalk line.

Figure 6:
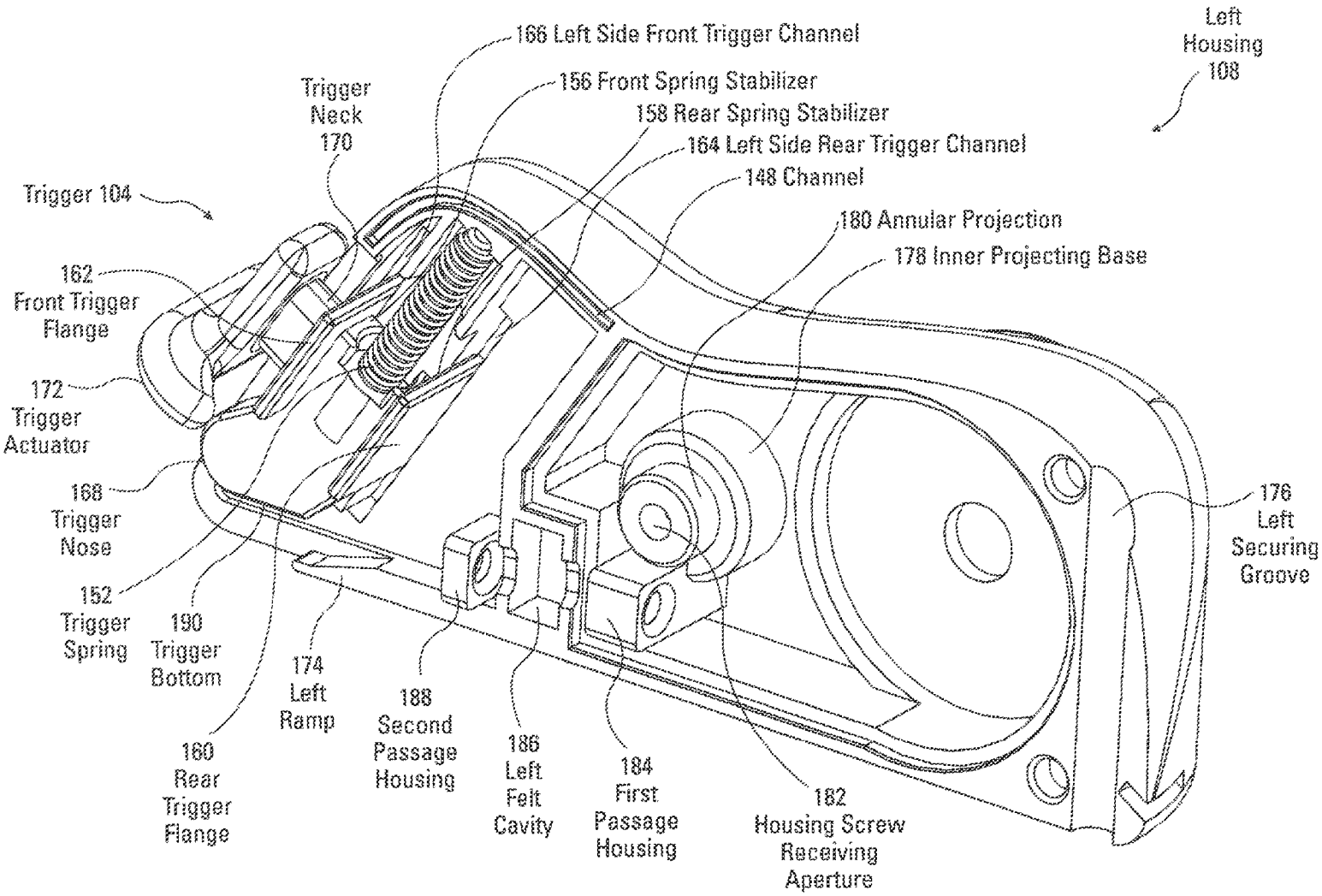
FIG. 6 is an isometric view of FIG. 4.

FIG. 6 is an isometric view of FIG. 4 showing the left housing 108. FIG. 6 further illustrates trigger actuator 172 and the shape. As discussed earlier, the shape of trigger actuator 172 allows a user to actuate the trigger 104 by either hand, in any position using whichever finger they desire on the left, right or the center of trigger actuator 172, which is desirable because the user could possibly be in a position where the trigger actuator 172 would otherwise be difficult to actuate. FIG. 6 shows another angle of trigger 104 and further illustrates trigger 104, trigger neck 170, trigger nose 168, and trigger bottom 190. As earlier discussed, when trigger 104 is actuated, front trigger flange 162 travels in left side front trigger channel 166 and rear trigger flange 160 travels in left side rear trigger channel 164. Also further shown in FIG. 6 is the front spring stabilizer 156 and the rear spring stabilizer 158 of trigger 104 that assist in keeping trigger spring 152 stabilized between the left housing 108 and the trigger 104. It should be noted that trigger 104 moves to create the chalk marking line, and not the housing 102 (FIG. 1). In other words, the housing 102 (FIG. 1) does not move to create a chalk marking line. The trigger being actuated is what causes marking cord 192 to move, and not either one of the left housing 108 or the right housing 110. There are several advantages to the housing 102 (FIG. 1) remaining static and the trigger 104 being the moving element that creates the chalk marking line. For example, there are fewer moving parts as compared to a device that uses its housing or additional parts to create a chalk marking line. Trigger 104 only has to move its own mass against trigger spring 152 which results in minimal wear and less spring force required in comparison to a device that uses its housing and other elements to create the chalk marking line. Additionally, the housing 102 (FIG. 1) remaining static and only the trigger 104 being moved to create the chalk marking line helps the powdered chalk stay within the housing 102 (FIG. 1), versus the chalk cavity being snapped and powdered chalk being more likely to be dispersed throughout the device and possibly leaking from the device. Additionally, although a helical spring is shown, other springs known in the art that bias outwardly can be used. FIG. 6 also further illustrates channel 148 of left housing 108 that mates with protruded track 150 of right housing 110 (FIG. 3). Also further shown are the first passage housing 184, the left felt cavity 186, and the second passage housing 188, which is where marking cord 192 (FIG. 7) passes through, as was discussed in FIGS. 4 and 5. Additionally, FIG. 6 further illustrates inner projecting base 178, annular projection 180, housing screw receiving aperture 182, and left securing groove 176 that was discussed earlier in FIG. 4.

Figure 9:
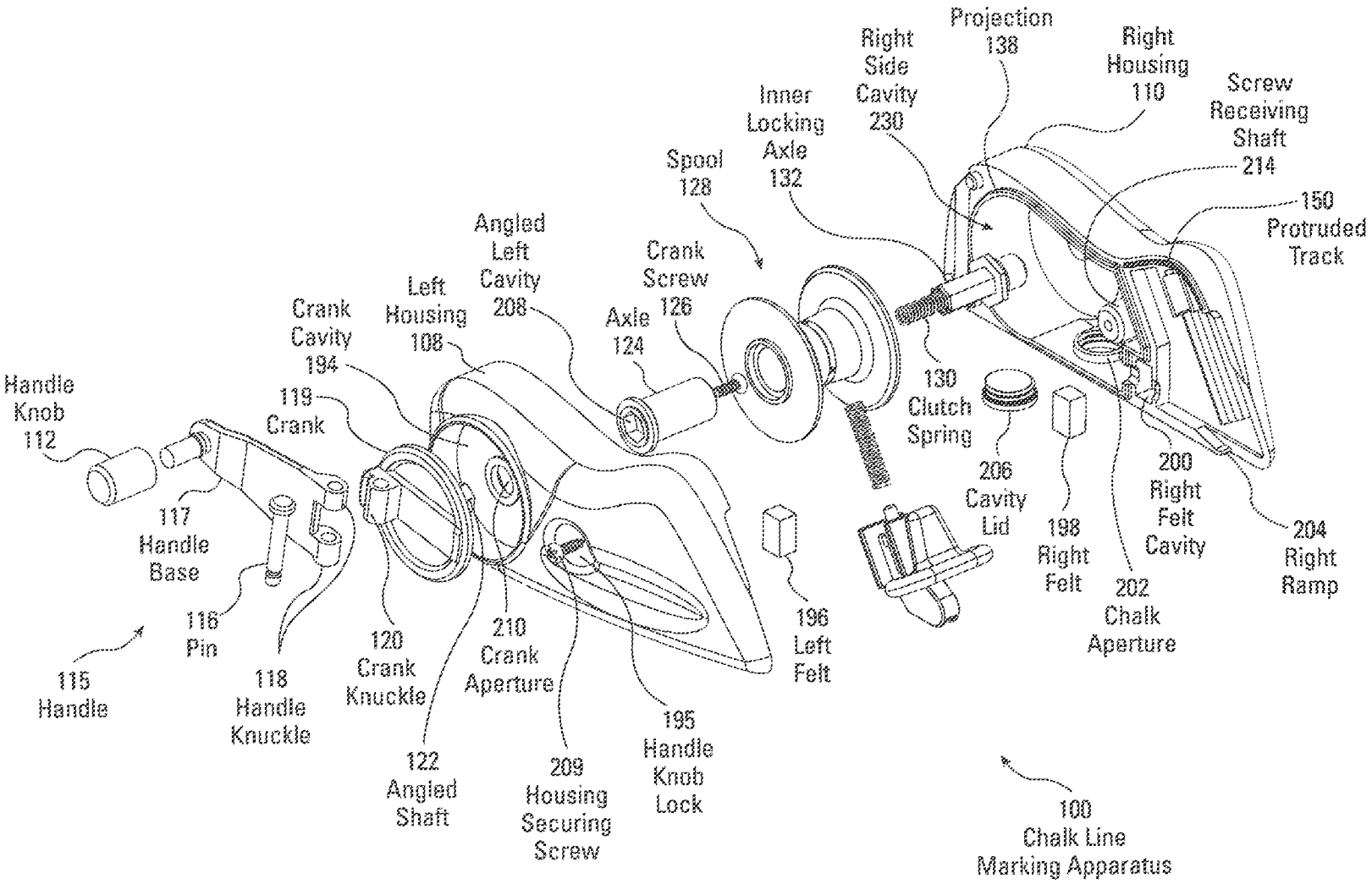
FIG. 9 is an isometric view of FIG. 2.

FIG. 7 is a side view of left housing 108 showing marking cord 192. Marking cord 192 that is wound around spool 128 is in left side cavity 228 that contains powdered chalk. Marking cord 192 passes through first passage housing 184, left felt cavity 196, and second passage housing 188. Left felt cavity 186 (FIG. 6) holds left felt 196. Left felt 196 and right felt 198 (FIG. 2) clear off excess powdered chalk disposed on marking cord 192. The powdered chalk in contained in the left side cavity 228 and right side cavity 230 (FIG. 9). Marking cord 192 enters trigger 104 at cord entry aperture 193 and travels downward through angled cord cavity channel 238, and exits trigger 104 at the cord cavity 195. As shown and earlier described, marking cord 192 goes through trigger 104 at a downward angle through angled cord cavity channel 238 and exits at cord cavity 195. The downward angle ensures that the marking cord 192 touches the surface to be marked when the marking cord extends from the cord cavity 195. Referring to back to FIG. 1, cord cavity 195 is located at a bottom portion of trigger 104 which allows marking cord 192 to be directly on the surface of the area to be marked. Cord cavity 195 and marking cord 192 are flush with the surface to be marked which creates a great degree of accuracy, as opposed to marking cord 192 exiting trigger 104 at a different location not flush with a surface, such as the trigger nose 168. Further illustrated in FIG. 7 is trigger actuator 172, front trigger flange 162, rear trigger flange 160, left side rear trigger channel 164, left side front trigger channel 166, and trigger spring 152.

FIG. 8 shows the trigger 104 and marking cord 192 of FIG. 7 in a downward position with marking cord 192 being flush with a surface being marked. In use, trigger actuator 172 of trigger 104 is pulled up against the bias of trigger spring 152. One side of front trigger flange 162 slides along the left side front trigger channel 166, and the other side of front trigger flange 162 slides along right side front trigger channel 234 of right housing 110 (FIG. 10). One side of rear trigger flange 160 slides along left side rear trigger channel 164, and the other side of rear trigger flange 160 slides along right side rear trigger channel 236 of right housing 110 (FIG. 10). In other words, flanges of trigger 104 slide along channels in the left and right housings. When trigger actuator 172 is released, the trigger 104 and the marking cord 192 are forced down by the bias of trigger spring 152 towards the surface to be marked, which causes marking cord 192 to be snapped down on the marking surface, and a chalk line mark is produced. FIG. 8 further illustrates marking cord 192 exiting cord cavity 195 which is flush with trigger bottom 190 and the marking surface.

Figure 11:
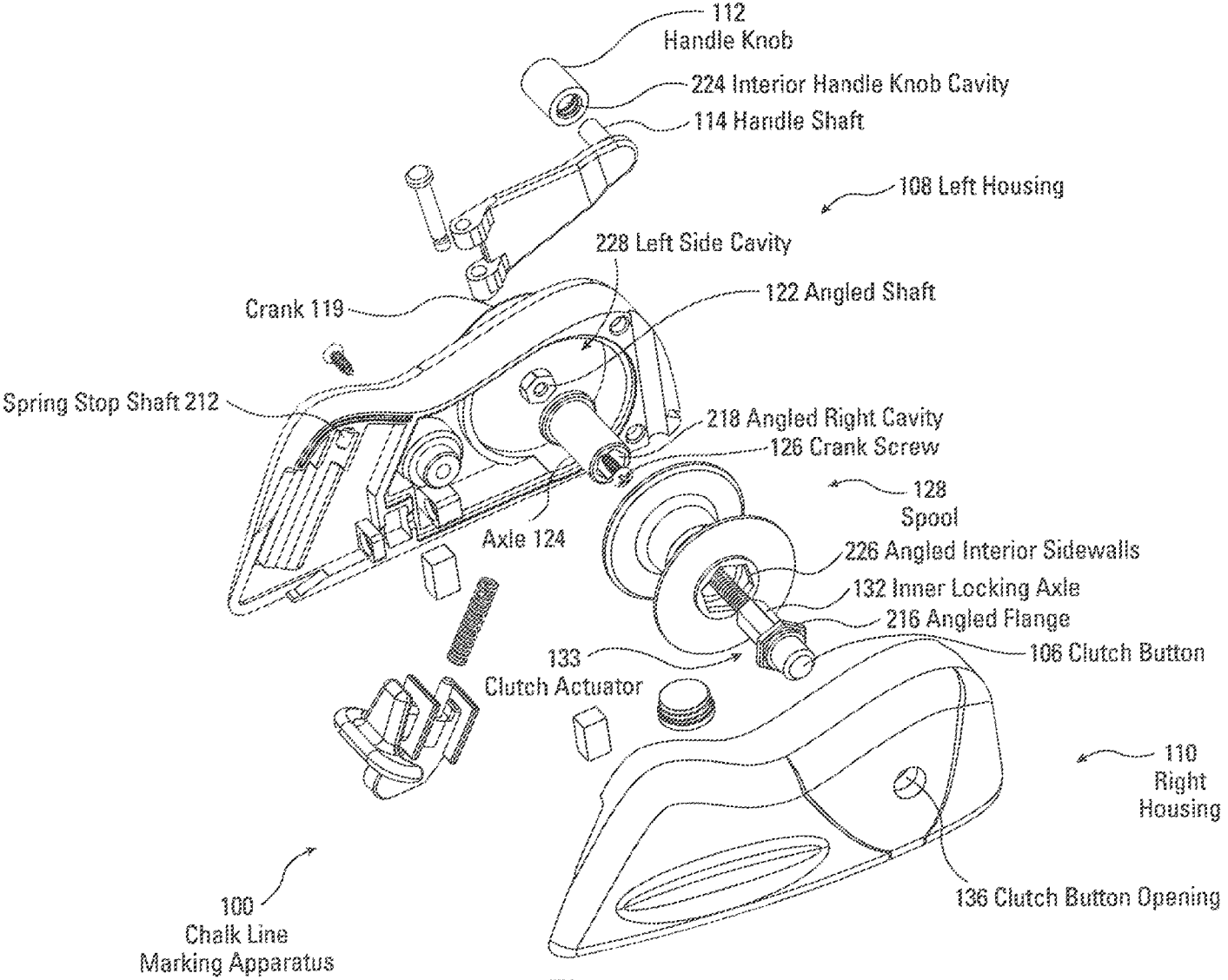
FIG. 11 is an isometric view of FIG. 2.

FIG. 9 is an isometric view of FIG. 2, showing chalk line marking apparatus 100. FIG. 9 shows handle 115 having handle base 117, and crank 119. As previously discussed, crank knuckle 120 aligns with handle knuckle 118, and pin 116 is used to make a rotatable hinge between handle base 117 and crank 119. Crank 119 is disposed in crank cavity 194, and angled shaft 122 goes through crank aperture 210 of left housing 108. Angled shaft 122 mates with angled left cavity 208 of axle 124. Crank screw 126 secures crank 119 with axle 124. Spool 128 slides on axle 124. Inner locking axle 132 goes through spool 128 and mates with angled right cavity 218 (FIG. 11). Right side cavity 230 holds the other side of spool 128. FIG. 9 also shows cavity lid 206 that closes chalk aperture 202. Chalk aperture 202 is where powdered chalk is inserted in chalk line marking apparatus 100. Cavity lid 206 keeps the chalk inside of the chalk line marking apparatus 100. The right felt 198 and left felt 196 assist in keeping the powdered chalk inside of right side cavity 230 and left side cavity 228 (FIG. 8). FIG. 9 also shows projection 138 and protruded track 150 that mate with groove 124 and channel 148 (FIG. 4). Chalk line marking apparatus 100 has a right ramp 204 and right felt cavity 200 that are similar to left ramp 174 and left felt cavity 186, earlier discussed with respect to FIG. 5. Additionally, FIG. 9 also shows housing securing screw 209 that goes through the cavity of handle knob lock 195 and is fastened into screw receiving shaft 214 located on right housing 110, so that left housing 108 and right housing 110 are coupled together. Handle knob lock 195 can receive handle knob 112 so that handle 115 can be in a flat position while marking a chalk line.

FIG. 10 is an isometric view of chalk line marking apparatus 100 of FIG. 2. FIG. 10 further illustrates right housing 110 having right side cavity 230, upper shaft 144, lower shaft 216, right securing groove 218 and screw receiving shaft 214. FIG. 10 also shows spool 128, crank screw 126, inner wall aperture 222, inner wall 220, and angled left cavity 208. FIG. 10 also shows left housing 108 having left securing groove 176 earlier discussed. Additionally FIG. 10 shows another view of trigger 104 having trigger shaft 154, rear trigger flange 160, front trigger flange 162, trigger neck 170, and trigger spring 152.

FIG. 11 is an isometric view of chalk line marking apparatus 100 of FIG. 2. FIG. 11 further illustrates handle knob 112 having interior handle knob cavity 224 that attaches to handle shaft 114 in a rotatable manner. FIG. 11 also shows left housing 108 having left side cavity 228, crank 119 with angled shaft 122 protruding through left side cavity 228. Angled shaft 122 mates with axle 124 and is secured to crank 119 with crank screw 126. FIG. 11 also shows angled right cavity 218 of axle 124 that receives and mates with inner locking axle 132. Spool 128 has angled interior side walls 226 that can mate with angled flange 216 when clutch button 106 is not pressed. Clutch button 106 protrudes out of clutch button opening 136 of right housing 110 when left housing 108 and right housing 110 are coupled together.

Figure 12:
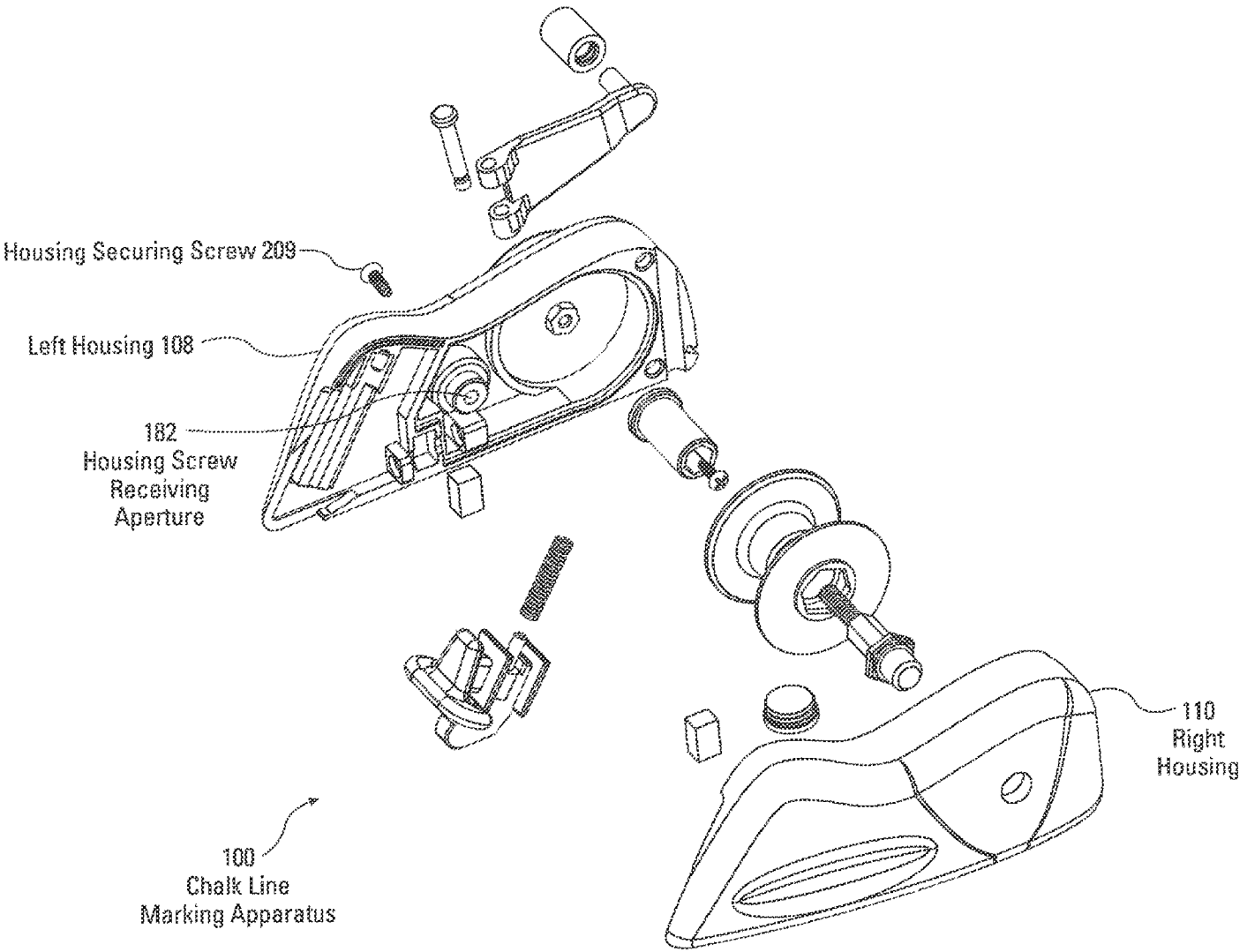
FIG. 12 is an isometric view of FIG. 2.

FIG. 12 is an isometric view of chalk line marking apparatus 100 of FIG. 2 and further illustrates how right housing 110 and left housing 108 are coupled together by housing securing screw 209 through housing screw receiving aperture 182.

Figure 13:
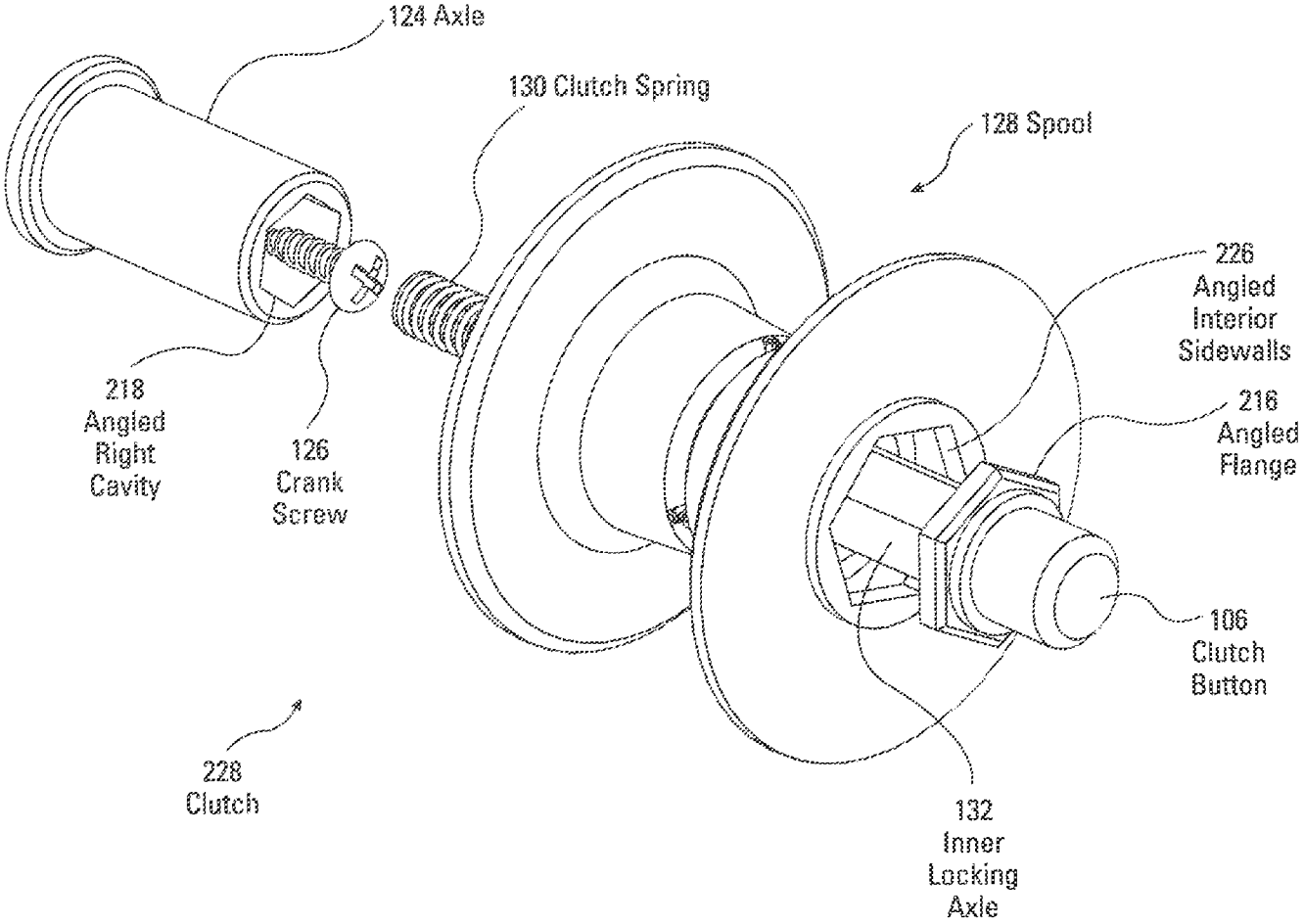
FIG. 13 is an isometric view of the clutch shown in FIG. 2.

FIG. 13 is an isometric view of clutch 228. When clutch button 106 is pressed inwardly, marking cord 192 (FIGS. 7-8) can be freely pulled and unwound from spool 128. Clutch spring 130 is disposed between angled right cavity 218 and inner locking axle 132. Inner locking axle 132 is disposed inside of angled right cavity 218, and clutch spring 130 biases clutch button 106 in an outward direction. Additionally, although a helical spring is shown, other springs known in the art that bias outwardly can be used. At rest, angled flange 216 mates with the angled interior sidewalls 226 of spool 128, and the crank 119 (FIG. 14) can wind spool 128 via handle 115 (FIG. 14), so that a user can wind marking cord 192 (FIGS. 7-8) back on to spool 128. When clutch button 106 is pressed inwardly against the bias of clutch spring 130, angled flange 216 is clear from, and does not engage, the angled interior sidewalls 226 of spool 128, so that spool 128 can freely rotate about axle 124. When clutch button 106 is pushed in and angled flange 216 is clear from the angled interior sidewalls 226 of spool 128, a user can freely pull marking cord 192 (FIGS. 7-8) from spool 128, and out of the chalk line marking apparatus 100. As such, the user can extend the marking cord 192 out at least as far as an arm length and snap the marking cord 192 using the trigger 104. In this way, a single user can quickly and easily mark a surface without the assistance of another person or the use of a screw or nail to secure the end of marking cord 192. FIG. 13 also further illustrates crank screw 126, previously discussed.

Figure 14:
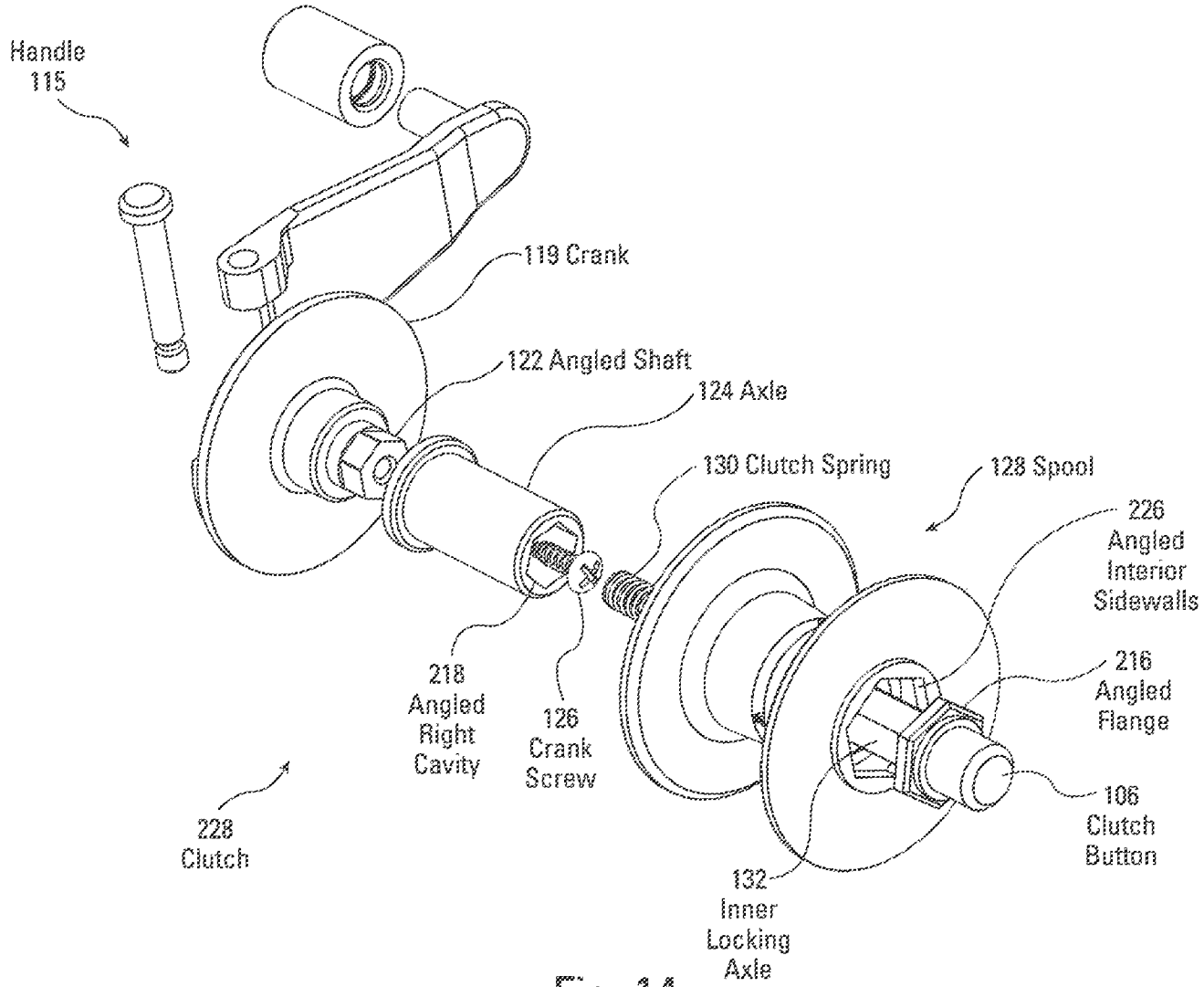
FIG. 14 is a side isometric view of the handle and clutch shown in FIG. 2.

FIG. 14 is a side isometric view of handle 115 and clutch 228. FIG. 14 further illustrates how the angled shaft 122 of crank 119 mates with axle 124. Crank screw 126 secures axle 124 and crank 119 to the left housing 108 (FIG. 2). Crank screw 126 goes inside of the angled right cavity 218 of axle 124, through the left housing 108, and through angled shaft 122 so that axle 124 and crank 119 are secured to left housing 108. FIG. 14 also shows clutch spring 130, spool 128, angled interior side walls 226, inner locking axle 132, angled flange 216, and clutch button 106.

Figure 15:
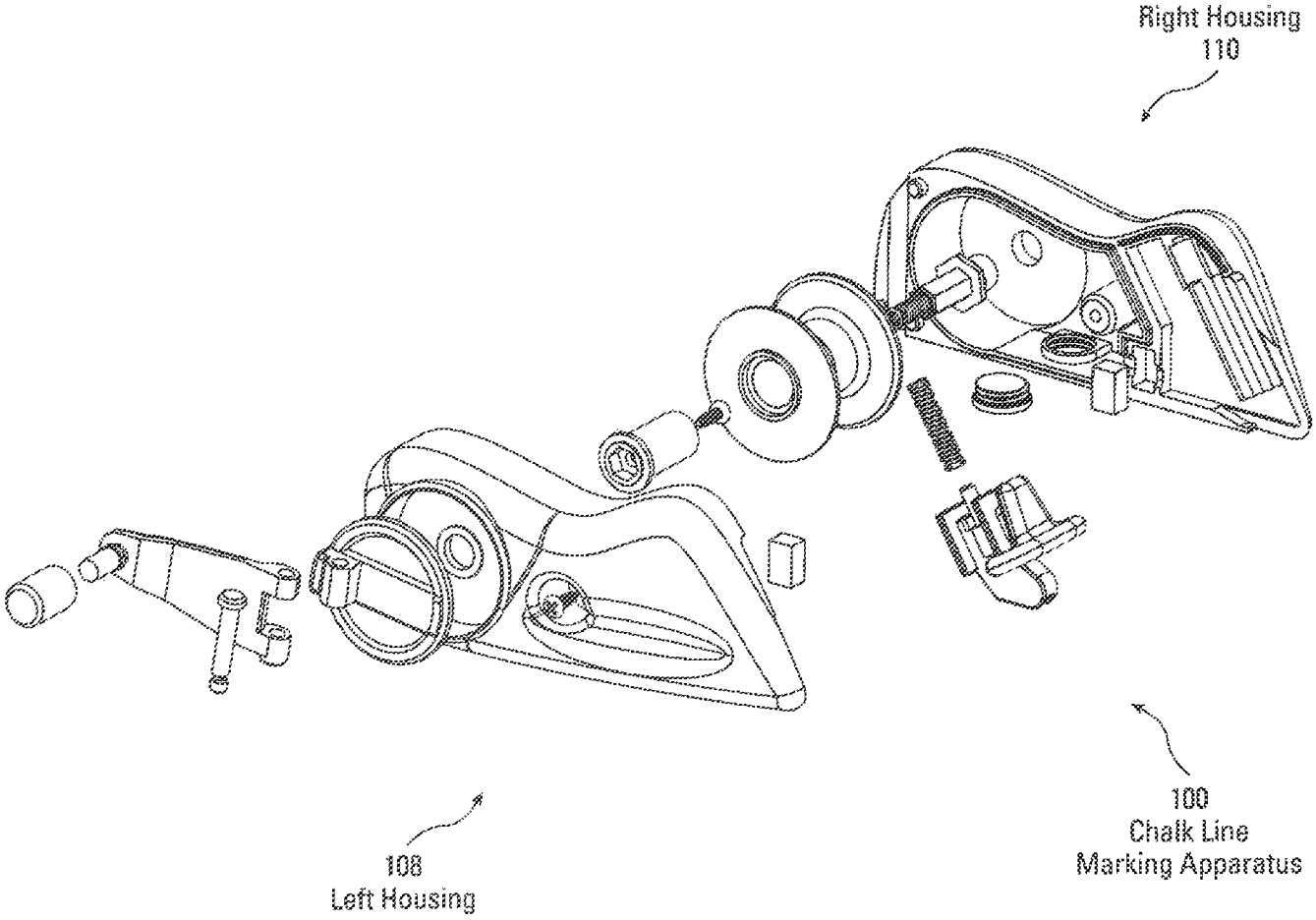
FIG. 15 is an isometric view of FIG. 2.

FIG. 15 is an isometric view of FIG. 2 showing chalk line marking apparatus 100. FIG. 15 further illustrates the right housing 110, the left housing 108, and the other components previously discussed.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A chalk line marking apparatus comprising:

a left housing;

a right housing coupled to said left housing, said left housing and said right housing forming a chalk cavity when joined together;

a handle comprising a handle base and at least one handle knuckle;

a crank comprising an angled shaft and at least one crank knuckle;

a pin hingedly connecting said at least one handle knuckle and said at least one crank knuckle so that said handle base is configured to rotate about said crank;

a spool configured to hold a marking cord;

an axle comprising an angled left cavity that mates with said angled shaft of said crank and is secured to said crank by a crank screw;

a clutch that allows said marking cord to be unwound from said spool;

a trigger comprising a trigger bottom, a trigger actuator, a front trigger flange, a rear trigger flange, a trigger shaft, a cord entry aperture, a cord cavity located on said trigger bottom, and an angled cord cavity channel that extends at an angle between said cord cavity aperture and said cord cavity;

a trigger spring having one end disposed on said trigger shaft, and an opposite end of said trigger spring disposed on a spring stop shaft located on said left housing, wherein said trigger spring is configured to bias said trigger in a downward direction towards a surface to be marked so that said chalk line marking apparatus marks a chalk line on a surface.

2. The chalk line marking apparatus of claim 1 further comprising:

a clutch actuator having an angled flange, a clutch button, and an inner locking axle having edges that are configured to mate with an angled right cavity of said axle;

a clutch spring disposed between said angled right cavity of said axle and said inner locking axle so that said clutch spring biases said clutch button outwardly and through a clutch button opening on said right housing.

3. The chalk line marking apparatus of claim 1 further comprising:

a housing securing screw that secures said left housing to said right housing;

a channel and a groove located on said left housing;

a protruded track and a projection located on said right housing wherein said protruded track is disposed in said channel of said left housing, and said projection is disposed in said groove of said left housing so that said chalk line marking apparatus creates a water resistant seal.

4. The chalk line marking apparatus of claim 1 further comprising:

a left side front trigger channel and a left side rear trigger channel located on said left housing, wherein a left side of said front trigger flange and a left side of said rear trigger flange are disposed, and configured to slide along said left side front trigger channel and said left side rear trigger channel respectively;

a right side front trigger channel and a right side rear trigger channel located on said right housing, wherein a right side of said front trigger flange and a right side of said rear trigger flange are disposed and configured to slide along said right side front trigger channel and said right side rear trigger channel respectively;

a trigger neck that extends from said front trigger flange and is configured to slide along a trigger slot between said right housing and said left housing.

5. The chalk line marking apparatus of claim 1 further comprising:

a first passage housing and a second passage housing that protrude from said left housing and are configured to guide said marking cord from said spool to said trigger;

said left housing having a left side cavity that holds powdered chalk and part of said spool in a left side spool cavity;

a left felt disposed in a left felt cavity located between said first passage housing and said second passage housing on said left housing.

6. The chalk line marking apparatus of claim 5 further comprising:

a cavity lid removably disposed on said right housing that is configured to retain chalk inside of said chalk line marking apparatus by closing a chalk aperture where powdered chalk is added to said chalk line marking apparatus;

a right felt disposed in a right felt cavity, and wherein said right felt and said left felt are configured to retain said powdered chalk inside of said chalk line marking apparatus.

7. The chalk line marking apparatus of claim 1 further comprising:

a handle shaft that protrudes from said handle base;

a handle knob rotatively connected to said handle shaft so that said handle knob is configured to rotate about said handle shaft and move said crank via said handle base.

8. The chalk line marking apparatus of claim 1 wherein said trigger is ambidextrous with said trigger actuator has a shape that protrudes forward of said left housing and said right housing, and extends beyond said left housing and said right housing.

9. A method of using a chalk line marking apparatus comprising:

allowing a marking cord inside of said chalk line marking apparatus to be covered with powdered chalk contained in a chalk cavity formed by a right side housing and a left side housing;

pulling said marking cord from a marking cord cavity using a clutch that allows a spool, wound with said marking cord, to rotate and unwind from said spool, said marking cord cavity located on a bottom side of a trigger;

moving said marking cord, as said marking cord is pulled from said marking cord cavity, through an angled cord cavity channel through a trigger at a downward angle so that said marking cord exits said trigger from said cord cavity, located at a bottom side of said trigger, at a downward angle that ensures that said marking cord contacts a marking surface;

lifting a trigger actuator of a trigger against a bias created by a trigger spring so that a front trigger flange moves along a left side front trigger channel and a right side front trigger channel, and a rear trigger flange moves along a left rear trigger channel and a right side rear trigger channel of a left housing and a right housing;

moving a trigger neck along a trigger slot located between said left housing and said right housing by said lifting said trigger actuator;

releasing said trigger actuator so that said trigger spring forces said trigger and said marking cord downwardly towards a surface to be marked so that said cord is flush with said surface.

10. The method of claim 9, further comprising:

rotating a handle knob that rotates about a handle shaft and a handle base, and said rotating said handle knob rotates a crank that winds said marking cord on said spool so that said marking cord travels inside of said chalk line marking apparatus.

11. A method of making a chalk line marking apparatus comprising:

passing a marking cord from a spool through a first passage housing and a second passage housing of said chalk line marking apparatus;

passing said marking cord through a cord entry aperture on a trigger, through an angled cord cavity channel on said trigger, and out of said angled cord cavity channel on a bottom portion of said trigger that ensures that said marking cord contacts a surface to be marked and creates an accurate chalk line mark on said surface to be marked when said trigger is actuated;

providing trigger guides on said chalk line marking apparatus that allow said trigger to move said marking cord and compress a trigger spring so that said marking cord is snapped against said surface to be marked when said trigger is released.

12. The method of claim 11 further comprising:

aligning at least one handle knuckle with a crank knuckle and securing with a pin so that a handle base rotates about a crank.

13. The method of claim 12 further comprising:

disposing said crank in a crank cavity so that an angled shaft of said crank protrudes through a crank aperture on a left housing.

14. The method of claim 13 further comprising:

coupling said angled shaft of said crank with an angled left cavity of an axle;

securing said axle to said crank with a crank screw.

15. The method of claim 14 further comprising:

disposing one side of a front trigger flange in a left side front trigger channel, and one side of a rear trigger flange in a left side rear trigger channel.

16. The method of claim 15 further comprising:

disposing a trigger shaft inside of one end of said trigger spring and disposing an opposite side of said trigger spring on a spring stop shaft of said left housing;

sliding said spool on said axle.

17. The method of claim 16 further comprising:

disposing one end of a clutch spring in an angled right cavity of said axle, and disposing an opposite end of said clutch spring in an inner locking axle of a clutch actuator.

18. The method of claim 17 further comprising:

disposing another side of said front trigger flange in a right side front trigger channel, and another side of said rear trigger flange in a right side rear trigger channel.

19. The method of claim 18 further comprising:

coupling a projection of a right housing with a groove of said left side housing.

20. The method of claim 19 further comprising:

disposing a protruded track of said right side housing in a channel of said left side housing.

21. The method of claim 20 further comprising:

disposing a clutch button through a clutch button opening of said right housing.

22. The method of claim 21 further comprising:

dispensing powdered chalk in a chalk aperture on said right side housing;

securing a cavity lid on chalk aperture to retain said powdered chalk inside of said chalk line marking apparatus.

23. The method of claim 22 further comprising:

securing said left housing to said right housing by fastening a housing screw to a screw receiving shaft on said right housing, wherein said housing screw extends from said left housing to right housing.

24. The method of claim 23 further comprising:

disposing a left felt in a left felt cavity of said left housing, and a right felt in a right felt cavity of said right housing.

* * * * *